US006655257B1

(12) United States Patent
Meyer

(10) Patent No.: US 6,655,257 B1
(45) Date of Patent: Dec. 2, 2003

(54) DIAPHRAGM PUMP

(75) Inventor: André Meyer, Ettiswil (CH)

(73) Assignee: KNF Flodos AG, Sursee (CH)

( * ) Notice: Subject to any disclaimer, the term of this patent is extended or adjusted under 35 U.S.C. 154(b) by 0 days.

(21) Appl. No.: 09/913,449

(22) PCT Filed: Jan. 20, 2000

(86) PCT No.: PCT/EP00/00423

§ 371 (c)(1),
(2), (4) Date: Aug. 14, 2001

(87) PCT Pub. No.: WO00/49293

PCT Pub. Date: Aug. 24, 2000

(30) Foreign Application Priority Data

Feb. 16, 1999 (DE) ..... 199 06 317

(51) Int. Cl.[7] ..... F01B 19/00
(52) U.S. Cl. ..... 92/99; 417/413.1
(58) Field of Search ..... 92/96, 97, 98 R, 92/99, 100, 101, 102; 417/413.1

(56) References Cited

U.S. PATENT DOCUMENTS 4,238,992 A 12/1980 Tuck, Jr.
5,634,391 A 6/1997 Eady
5,724,881 A 3/1998 Reynolds
5,743,170 A 4/1998 Pascual et al.
5,776,098 A * 7/1998 Silver et al. ..... 604/74

FOREIGN PATENT DOCUMENTS

DE 19631081 C1 10/1997

* cited by examiner

*Primary Examiner*—Edward K. Look
*Assistant Examiner*—Michael Leslie
(74) *Attorney, Agent, or Firm*—Volpe and Koenig, P.C.

(57) ABSTRACT

A diaphragm pump with a diaphragm (1) of elastic material, which includes a receiving cavity (4) in a reinforced central area (3) for a connecting rod head (5) of a connecting rod which displaces the diaphragm (1). The diaphragm (1) includes a clamping rim (2) for securing the diaphragm to the pump housing. On the upper side (8) of the diaphragm (1) which is proximal to the pump chamber, at least one circularly disposed rib (9) is provided essentially radially outward from and proximal to a central area (3) which area is bounded by the outline of the connecting rod head (5) or by the outline of a part of the diaphragm (1) near to the said connecting rod head (5). A plurality of ribs (9), spaced in a radial direction one from the other are provided and are located where the forces introduced by the connecting rod head (5) spread into the radial, neighboring ring area of the diaphragm.

10 Claims, 1 Drawing Sheet

FIG. 1
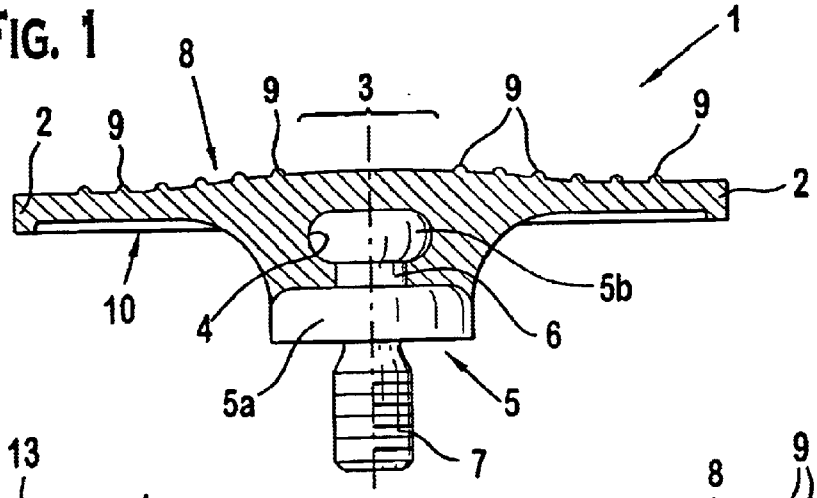
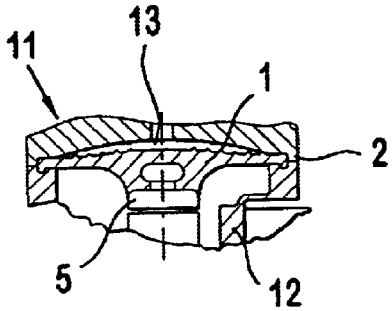
FIG. 4
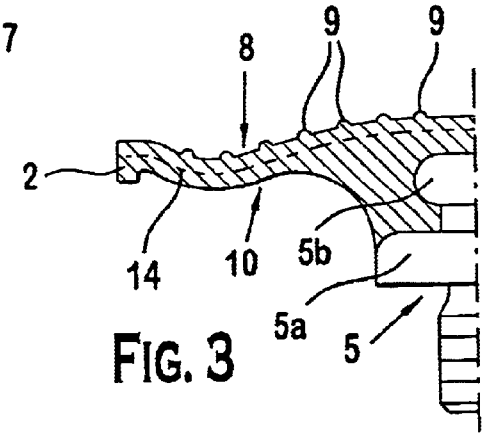
FIG. 3
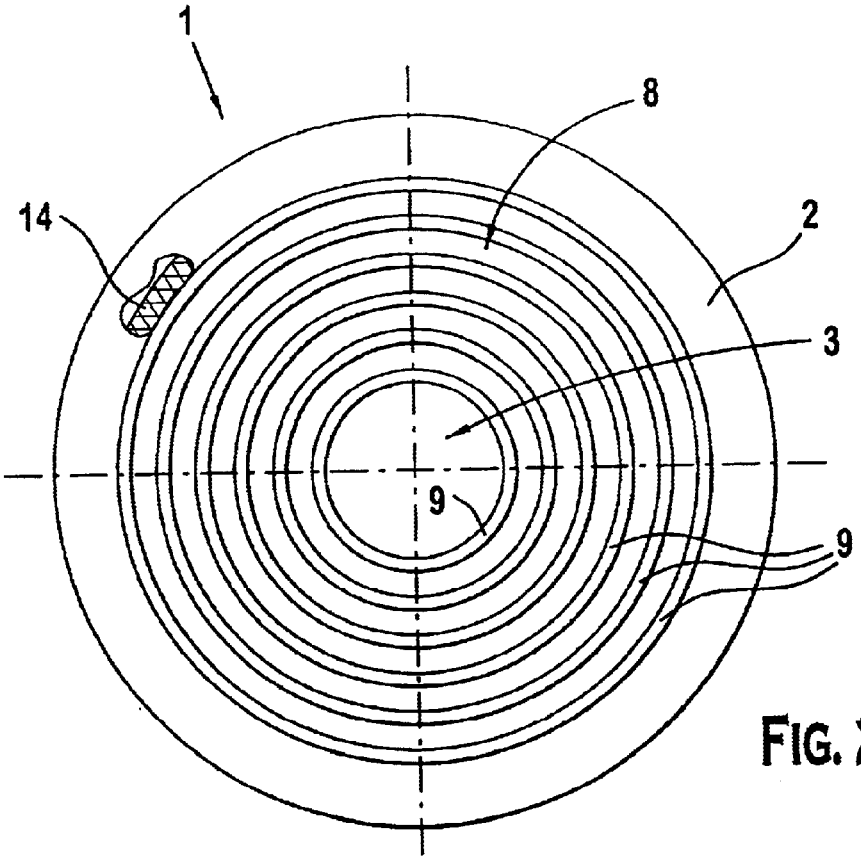
FIG. 2

DIAPHRAGM PUMP

BACKGROUND

The invention relates to a diaphragm pump with a diaphragm of elastic material, which, in its reinforced central area, possesses a cavity for the head of a connecting rod having a reciprocating motion which moves the diaphragm between top and bottom dead center points. The diaphragm is secured by its outer rim to the pump housing. In the case of most molded in connecting rod heads, when the corresponding diaphragms are used at elevated pressures, experience has shown that diaphragms in pumps of this type are damaged in a surprisingly short time by developing fissures on their upper side.

SUMMARY

The object of the present invention is to create a diaphragm pump of the type mentioned in the above introductory passage, having a diaphragm which can operate for a long period without damage at higher pressure loadings, and, possibly, also higher speeds of rotation, such as, for example, 4,500 RPM of the drive shaft. In case of need, the capability for even a higher pump capacity should be present.

For the achievement of this object, what is proposed is that at least one peripherally disposed rib be provided essentially radially outward from, and proximal to, a central area, which area is bounded by the outline of the connecting rod head or limited by the outline of a part of the diaphragm near to the said connecting rod head.

DE 196 31 081 C1, to be sure, does disclose a diaphragm, which exhibits corrugations on one side, largely to compensate for a compression of the diaphragm material, wherein the deepest points of the corrugations project from the underside of the diaphragm as weak undulations. The compression of the diaphragm material, by these measures, can indeed be reduced or avoided by deflecting the diaphragm in the direction of certain areas. Nevertheless a weakening of the diaphragm has been incurred, since the loss of strength of the material called forth by the relatively deeply impressed corrugations reflected on the other side cannot be compensated for.

Also, U.S. Pat. No. 4,238,992 shows a diaphragm, which has ribs on its reverse side. This diaphragm is provided for a pump which is powered by liquid or air pressure. In order to improve the operational life of such a diaphragm by the use of a material of relatively greater stiffness, ribs are provided on the pressure driven side.

In the case of the present invention, at least one encircling rib, intended as a reinforcement rib, is purposely placed on the front side of the diaphragm, where the forces transmitted into the diaphragm from the connecting rod head spread into the radially adjoining annular area of the diaphragm. By the fact that the rib(s) extend in its circumferential direction in this force transmission zone, where also large bending and loading occurs, a greater structural strength of the diaphragm to counter the pressure is achieved. At the same time, the flexibility of the diaphragm is maintained which acts against fissure formation. Empirical trials have shown, that even under conditions made more severe—that is, increased pressure, high RPM—an essentially longer operational life is brought about for the diaphragm, than is the case with diaphragms without reinforcing ribs, at least ribs in the corresponding area.

It is particularly advantageous, if a plurality of concentric ribs are provided, which are radially spaced apart one from the other, and located proximal to the central area of the diaphragm. In this way, a stabilizing effect is brought to the surrounding zone of the especially critical force transmission area between the outline of the connecting rod head and the radially, outward extending annular diaphragm surface. Moreover, because of the force diversion capability of the diaphragm, a greater pump capacity is possible.

The danger of the formation of fissures and general damage decreases in proportion to greater radial distance from the critical force transmission zone near the connecting rod head. This characteristic leads to an additional development of the invention, wherein a multiplicity of circular ribs are separated from one another and accordingly, the separation distances in the central area can be less than the separation distances farther outward.

BRIEF DESCRIPTION OF THE DRAWINGS

Additional embodiments of the invention are described in the dependent claims. In the following, the preferred embodiment of the invention is more closely described and illustrated with the help of the drawings, in which:

FIG. 1 is a cross-sectional view of a diaphragm with a connecting rod in a relaxed mode, FIG. 2 is a top view of the diaphragm shown in FIG. 1, and FIG. 3 is a half cross-sectional of a diaphragm with connecting rod.

FIG. 4 is a cross-sectional view of the diaphragm of FIG. 1 shown in a housing of a diaphragm pump.

DETAILED DESCRIPTION OF THE PREFERRED EMBODIMENTS

The diaphragm 1 shown in FIG. 1 is a component of a diaphragm pump, which is not illustrated here, wherein the diaphragm 1, is peripherally, usually circumferentially, secured between by a clamping rim 2 between the pump casing head and the crankcase. In its reinforced central area 3, the diaphragm 1 possesses a cavity 4 to receive a connecting rod head 5. In the described embodiment, the connecting rod head 5 has two parts 5*a*, 5*b*, which are axially separated and are of different diameters. These parts 5*a*, 5*b* are joined together by a neck section 6. On the side remote from the diaphragm, the connecting rod head possesses a threaded support 7, which can be connected to the connecting rod.

The connecting rod head, with the part 5*b*, and with the neighboring part 5*a*, is normally molded into the reinforced central area 3 of the diaphragm 1. In place of the formation shown here of the connecting rod head 5 penetrating into the center of the diaphragm 1, parts of other shapes can be provided. The introduction of the thrust movement of the connecting rod is carried out by the connecting rod head, wherein, the connecting rod carries out a reciprocal oscillating thrust motion imparted by a crankshaft drive. As the pump movement takes place, the diaphragm's upperside 8, proximal to the pump chamber, is subjected to pressure, whereby the pressure transmission from the connecting rod onto the diaphragm by means of the connecting rod head 5 is completed. The principle loading, in the case of this force transmission, is exerted in the rim area of the connecting rod head 5. Experience has shown, that fissures are most likely to form on the upper side 8 of the diaphragm 1 following the periphery of the of the connecting rod head 5 which is proximal to the diaphragm surface, or to a part thereof. In the present embodiment, the transmission zone is somewhat broader in the radial sense, because of the varied diameters of the two connecting rod head components 5*a*, 5*b*, so that the introduction of the force and the transmission thereof is accomplished over a broader section.

In regard to the connecting rod head part 5*b*, which is the part of somewhat smaller diameter, in its outwardly projected extension to the upper side 8 of diaphragm 1 lies the critical, force transmission zone and at least, in that area, are provided circumferentially extending ribs 9. Through these ribs 9, which are placed annularly on the upper side of diaphragm 8, a greater degree of structural strength is achieved for the diaphragm against pressure, while at the same time, flexibility is not lost. In particular, the forces in transmission from the connecting rod head 5 through the central area 3 of the diaphragm 1, were better assimilated by the diaphragm. Thereby, an essentially improved operational life of the diaphragm under pressure was attained. Simultaneously, there is achieved a greater capacity by the diversional shaping of the diaphragm 1, and especially in the case of an embodiment with a multiplicity of ribs 9, as may be seen in FIG. 2. The ribs 9 additionally improve the ability of the diaphragm 1 to expand itself into the surface proximal to the pump chamber, which surface is also subjected to pressure. This latter advantage leads, at equal force diversion, to a reduced stress in the diaphragm surface, that is, allows a greater diversionary capacity of the diaphragm.

FIG. 3 shows, in a half-sectional view, a diaphragm deformed by the thrust action of the pressure loaded upper side of the diaphragm. Here one can recognize that the first rib 9 is placed practically directly in the upward projection extension of the connecting rod head 5*b*.

Mention should also be made, that in the central area of the diaphragm 1, 3, ribs 9 can be arrayed, where, especially in the case of a coated diaphragm, the ribs work counter to an over-extension and corresponding damage in this central zone.

In the embodiment shown, coaxial ribs 9, extending circumferentially, are apportioned over practically the entire area of the upper side 8 of the diaphragm 1. The separating distances of the neighboring ribs are, in this case, about equal. These are concentrically arranged and have a circular appearance. However, it is possible for the ribs to have an elliptical or oval shape. In this case, it is of advantage, if an alignment of the ellipses with their minor axes coincides with the plane of the connecting rod motion. If this is done, then in a more exact manner, measures can be taken against loads on the diaphragm caused by the path of movement in the connecting rod plane, that is, the avoidance of an overloading of the diaphragm.

The underside 10 of the diaphragm is advantageously designed to be smooth, so that, on the part of this side, no material weakening takes place.

The cross section of the ribs 9 is shown in the embodiment as rounded off somewhat semi-circularly and the transition from the ribs to the respective bordering membrane surface is likewise faired into a half round profile. This configuration provides a good transfer condition for force and also has the advantage, that in the case of a surface coating, for instance with polytetrafluoroethylene, this also remains full surfaced and thus in the transition zones between the ribs and the diaphragm surface, a good adherence is achieved.

For the strengthening of the diaphragm, between the upper side 8 and the end of the connecting rod head 5 proximal to the said upper side 8, a reinforcement, for example in the form of a netting or a net-type reinforcing layer 14, shown for example in FIGS. 2 and 3, can be installed.

As shown in FIG. 4, the diaphragm 1 is located in a diaphragm pump 11 which has a housing 12, and the diaphragm 1 is secured by the clamping rim 2 on an outer periphery thereof to the pump housing 12. The chamber 13 of the pump 11 is located adjacent to the upper side of the diaphragm 1.

What is claimed is:

1. A diaphragm pump comprising a diaphragm (1) comprised of elastic material having a reinforced central area (3) with a receiving cavity (4) for a connecting rod head (5) of a connecting rod which displaces the diaphragm (1) between a top and a bottom dead center point, the diaphragm (1) is secured by a clamping rim (2) on an outer periphery thereof to the pump housing, wherein on an upper side (8) of the diaphragm (1) which is proximal to a chamber of the pump, at least one circularly disposed rib (9) is provided on the upper side (8) located radially outward from and proximal to a central area (3) bounded by an outline of the connecting rod head (5) or by an outline of a part of the diaphragm (1) near the connecting rod head (5).

2. A diaphragm pump in accordance with claim 1, wherein a plurality of ribs (9) are provided, which are placed proximal to the central area (3) and spaced from one another in a radial direction.

3. A diaphragm pump in accordance with claim 2, wherein the plurality of ribs (9) which are spaced from one another in a radial direction have a spacing that is smaller in an area of the central area (3) than a spacing further out in a radial direction.

4. A diaphragm pump in accordance with claim 1, wherein the plurality of spaced ribs are spaced from one another in a radial direction, with the spacing between the neighboring ribs being approximately equal.

5. A diaphragm pump in accordance with claim 1, wherein the ribs are concentrically arranged and have a circularly rounded profile.

6. A diaphragm pump in accordance with claim 1, wherein the ribs (9) have an oval or elliptical form, with minor axes thereof lying in a plane of the connecting rod movement.

7. A diaphragm pump in accordance with claim 1, wherein the diaphragm (1) has an underside (10) which is essentially smooth.

8. A diaphragm pump in accordance with claim 1, wherein the at least one rib has a round or rounded cross-section, and a transition from the at least one rib to a bordering diaphragm surface is rounded off.

9. A diaphragm pump in accordance with claim 1, wherein the diaphragm (1) is made of rubber or a rubber-elastic raw material and the diaphragm (1) may have a PTFE surface coating.

10. A diaphragm pump in accordance with claim 1, wherein the diaphragm includes a net-type reinforcing layer located between the upper side (8) and the connecting rod end (5) that is located proximal to the upper side (8).

* * * * *